US005504963A

United States Patent [19]

Bynum et al.

[11] Patent Number: 5,504,963

[45] Date of Patent: Apr. 9, 1996

[54] BACK SCRUBBER DEVICE AND METHOD OF MAKING SAME

[75] Inventors: Cheryl Bynum, Ransom Canyon; Randa Gray, Lubbock, both of Tex.

[73] Assignee: Bynum Concepts, Inc., Lubbock, Tex.

[21] Appl. No.: 231,040

[22] Filed: Apr. 22, 1994

[51] Int. Cl.[6] ..... A47K 7/03; A47K 7/02; A61H 7/00

[52] U.S. Cl. ..... 15/222; 15/208; 601/154; 601/137; 29/453; 264/103; 401/8

[58] Field of Search ..... 15/222, 208, 209.1, 15/210.1, 223, 225, 226; 128/63, 67; 401/8, 7, 6; 300/21; 601/136, 137, 132, 154; 29/453, 525.1; 264/103, DIG. 66, DIG. 70, DIG. 81

[56] References Cited

U.S. PATENT DOCUMENTS

| | | | |
|---|---|---|---|
| 269,247 | 12/1882 | Waters | 15/222 |
| 2,011,729 | 4/1935 | Reinhard | 26/80 |
| 2,423,484 | 7/1947 | Cosgro | 66/147 |
| 2,450,932 | 10/1948 | Beard | 26/80 |
| 2,517,067 | 8/1950 | Wedler | 26/80 |
| 2,652,615 | 9/1953 | Lasley | 26/80 |
| 2,798,515 | 7/1957 | York | 140/107 |
| 2,826,802 | 3/1958 | Beard | 26/80 |
| 3,140,330 | 7/1964 | Gutierrez | 26/80 |
| 3,281,884 | 11/1966 | Feil | 15/244 |
| 3,332,124 | 7/1967 | Beard | 26/51.3 |
| 3,345,668 | 10/1967 | Forrest | 15/209 |
| 3,508,286 | 4/1970 | Rosen | 8/151 |
| 3,959,841 | 6/1976 | Horne | 15/222 |
| 4,067,325 | 1/1978 | Olask | 15/222 |
| 4,196,490 | 4/1980 | Jonzon | 15/222 |
| 4,343,061 | 8/1982 | Hanazon | 15/210.1 |
| 4,462,135 | 7/1984 | Sanford | 15/105 |
| 4,473,929 | 10/1984 | Green | 26/80 |
| 4,761,849 | 8/1988 | Taylor | 15/222 |
| 5,144,744 | 9/1992 | Campagnoli | 29/446 |
| 5,295,280 | 3/1994 | Hudson et al. | 15/222 |

FOREIGN PATENT DOCUMENTS

| | | | |
|---|---|---|---|
| 1029241 | 1/9189 | Japan | 15/222 |

*Primary Examiner*—Gary K. Graham
*Attorney, Agent, or Firm*—Rosenblatt & Redano

[57] ABSTRACT

The invention is a device, and method of making said device, for scrubbing the body, preferably an elongated device for scrubbing a person's back. The scrubber is made from multiple loops of tubular, open-celled, non-porous netting intertwined to form a washing member secured at its ends by grips which may be used to hold the scrubber at each end. The netting should be durable, elastic, easy to clean, and should dry rapidly. A preferable netting is diamond mesh polyethylene netting. The scrubber of the present invention may be used repeatedly without the need for a separate washing to remove dirt and debris. Because the netting is open-celled and made of non-porous material, dirt and can be washed away by simple rinsing during a bath or shower.

15 Claims, 4 Drawing Sheets

BACK SCRUBBER DEVICE AND METHOD OF MAKING SAME

FIELD OF THE INVENTION

The present invention relates to washing or cleaning devices, and more particularly to a washing device that is especially suited for scrubbing the human back while showering or bathing.

BACKGROUND OF THE INVENTION

A number of washing implements have been used to scrub the human body. Such washing implements include washcloths, sponges, brushes, "loofahs" and other devices. Some of these implements are helpful to scrub areas of the body that are difficult to reach, such as the human back. Unfortunately, many of these implements are made of materials that either are not very durable, or are difficult to clean. Typically, such instruments must be washed in a washing machine or in a separate washing procedure in order to be thoroughly cleaned.

SUMMARY OF THE INVENTION

The invention is a device, and method of making said device, for scrubbing the body, preferably an elongated device for scrubbing a person's back. The scrubber is made from multiple loops of tubular, non-porous netting having an open-celled configuration intertwined to form a washing member secured at its ends by grips which may be used to hold the scrubber at each end. The netting should be durable, elastic, easy to clean, and should dry rapidly. A preferable netting is diamond mesh polyethylene netting. The scrubber of the present invention may be used repeatedly without the need for a separate washing to remove dirt and debris. Because the netting is open-celled and made of non-porous material, dirt can be washed away by simple rinsing during a bath or shower.

DETAILED DESCRIPTION OF THE INVENTION

Figure 1:
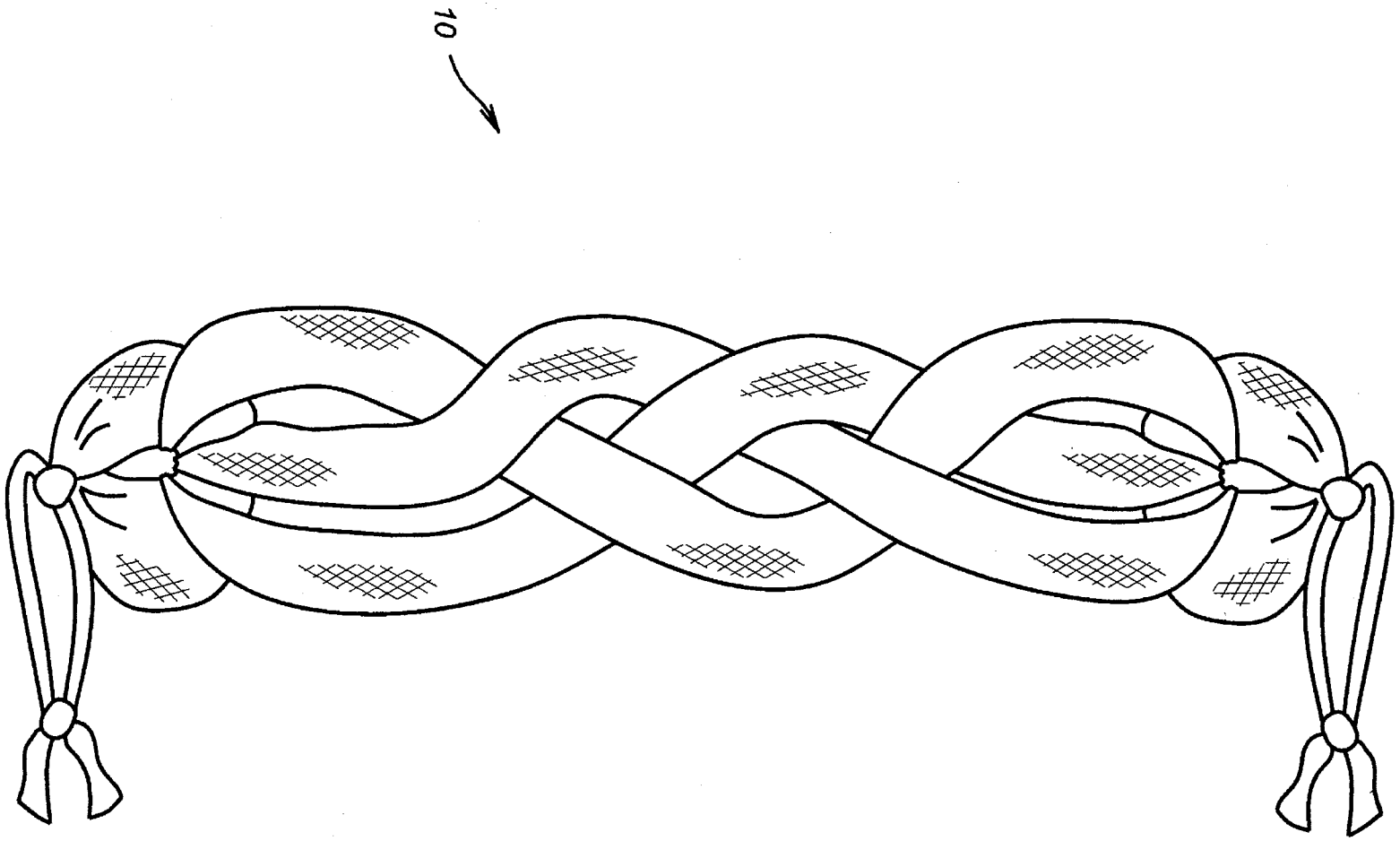
FIG. 1 is a perspective view of a completed scrubber according to the present invention.
Figure 2:
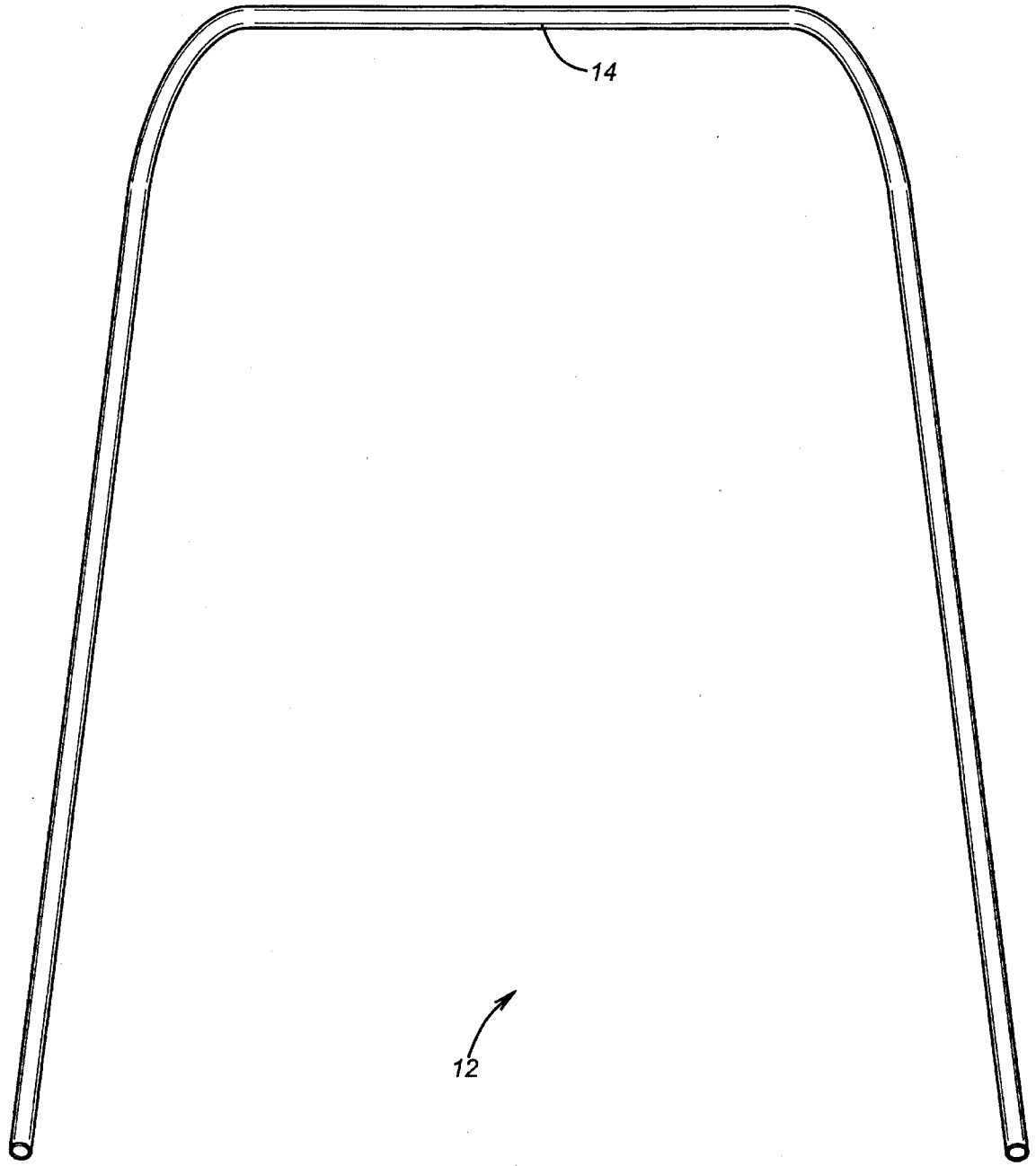
FIG. 2 is a perspective view of a mesh fabricator for use in connection with the present invention.

The scrubber 10 (FIG. 1) of the present invention will be best understood with reference to the method by which a preferred embodiment is assembled.

The scrubber 10 should be made of netting having open cells so that water from a shower or faucet can run through and clean the entire scrubber. The netting also should be made of a non-porous material so that dirt and debris do not become trapped in pores in the netting material, and so that the scrubber will dry rapidly. Although it is not absolutely necessary, it is preferable for the netting to be elastic. If the netting is elastic, it can be prestretched to add volume to the device along its length. Also, elasticity is desirable so that the netting can be stretched during use and return to its original shape after stretching.

The netting should be tubular so that separate loops of the tubular netting can be cut to form the scrubber. A preferred netting is diamond mesh polyethylene netting, which may be obtained from a number of manufacturers. One such manufacturer is "NALTEX®," 203 Colorado, Austin, Tex. 78701. In a preferred embodiment, the netting has a variety of complementary colors which, when intertwined, gives the scrubber 10 an aesthetically pleasing appearance.

The primary features of the present invention are (1) a plurality of loops of netting intertwined along their length to form an elongated washing member, and (2) grips securing the ends of the loops together and maintaining the loops intertwined. The intertwined loops preferably have a substantially continuous diameter. As used herein, the phrase "substantially continuous diameter" shall mean that the diameter may be substantially uniform along its length or may vary, e.g., by widening slightly at the central portion of the washing member. The grips at the ends of the intertwined loops allow the scrubber to be maneuvered to scrub the back or other portions of the body. The number of loops of netting used to make the scrubber 10 and the method of intertwining the loops may vary. However, the loops preferably are intertwined in a manner that creates a substantially continuous diameter which is substantially filled by the netting of the loops.

In a preferred embodiment, five loops are provided. The loops may be from tubes of netting having aesthetically pleasing and complementary colors. The width of the loops, measured along the axis of the tube of netting, may vary depending upon the type of netting used. If diamond mesh polyethylene netting is used, the loops preferably should be about 36 inches in width. The length (or diameter) of the loops before stretching (measured perpendicular to the axis of the tube of netting) may vary depending on the diameter of the tubing available and the desired length of the scrubber 10. Preferably, the diameter of the loops should be about 3 inches unstretched.

The loops do not have to be stretched before manufacturing the scrubber 10; however, as already mentioned, prestretching of the netting is preferred in order to add volume to the device along its length. Stretching of the loops can be accomplished using any known means. For example, a mesh fabricator 12 may be used. The mesh fabricator 12 preferably is made of metal or other relatively smooth, strong material having a "U" shape which is slightly smaller at the bottom 12 of the "U" than at the legs 14 of the "U". The loops of netting (not shown) may be urged over the narrower bottom 12 of the "U" and along the legs of the "U" to a point where the distance between the legs 14 is sufficient to stretch the loop. Preferably, the netting should be stretched to approximately 5–5½ times its unstretched length. For example, a 36 inch loop of diamond mesh polyethylene netting having a 3 inch diameter preferably should be stretched until it has a diameter of about 16 inches.

Figure 3:
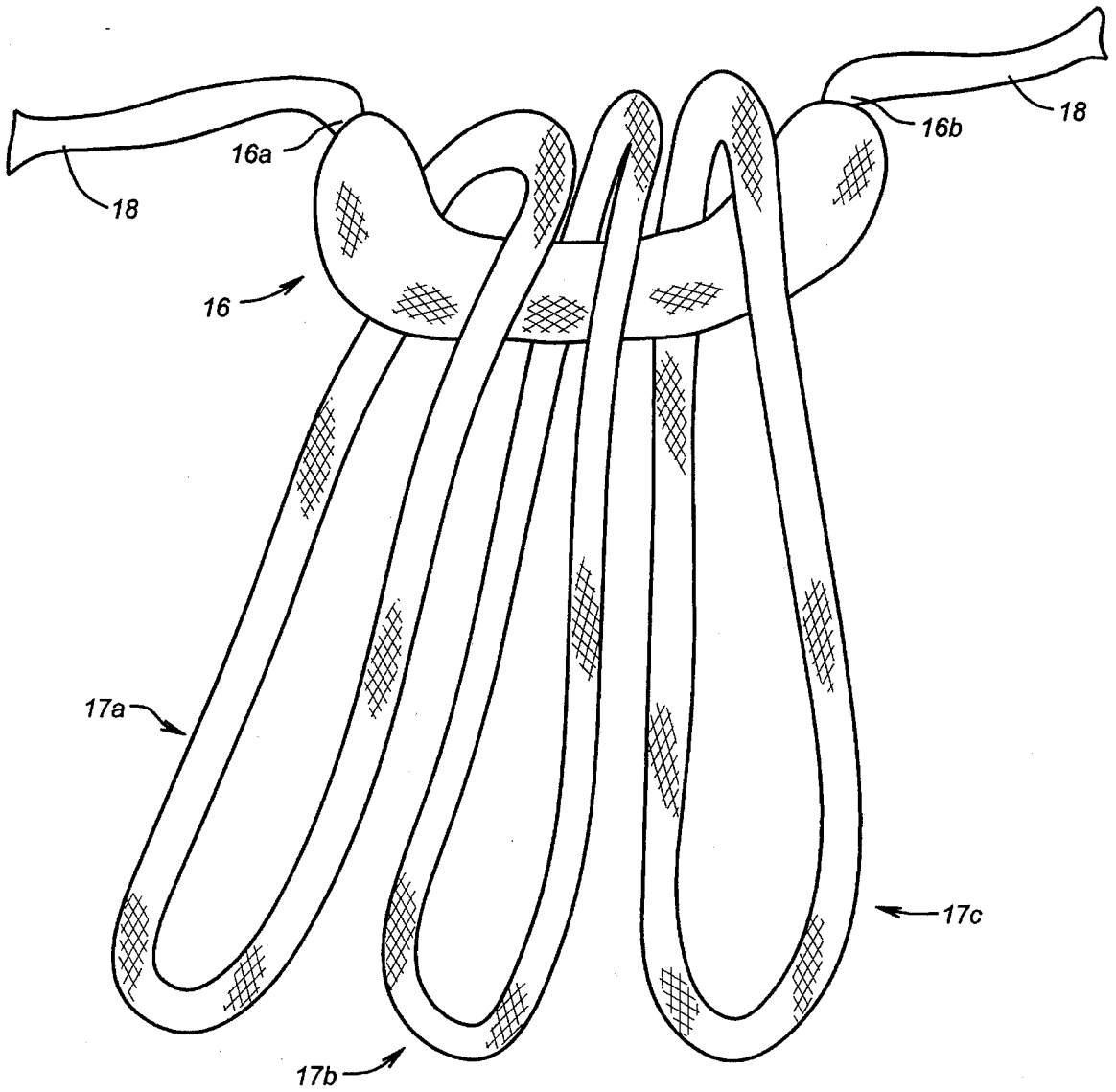
FIG. 3 is a perspective view of an early stage in the assembly of a scrubber according to the present invention.

In a preferred embodiment, one of the loops is removed from the mesh fabricator 12 after stretching to form a first "end loop" 16 (FIG. 3). The end loop 16 should be inserted through three of the loops **17*a*–17*c* and folded in half so that its ends 16*a* and 16*b* abut. The ends 16*a* and 16*b* of the end loop 16 should be secured together using any number of known means, thereby holding the loops 17*a*–17*c* in position adjacent to one another. Preferably, a single cord or braid is used to tie the ends 16*a* and 16*b* of the end loop 16** together. Alternately, each end 16*a* and 16*b* may be provided with a grip 18, and the grips 18 may be tied together. Or, the end loop 16 can be omitted, and the ends of loops 17*a*–17*c* can be tied together directly using a rope, cord, or other grip. Variations on a means for securing the ends of the loops 17*a*–17*c* will be evident to a person of skill in the art.

Preferably, an end loop 16 made of the same netting as loops 17 is inserted through the three loops 17*a*–17*c* while the three loops 17*a*–17*c* remain on the mesh fabricator 12. After the ends 16*a* and 16*b* of the end loop 16 are secured together, the three loops should be removed from the mesh fabricator 12 and the end loop 16 should be held secure while the loops 17*a*–17*c* are "braided" together. If desired, the end loop 16 can be replaced on the mesh fabricator 12 during this procedure. In a preferred embodiment, the loops 17*a*–17*c* are "braided" together, that is, the right and left loops 17*a* and 17*c* are alternately overlapped and "underlapped" on opposite sides of loop 17*b*, to result in the configuration shown in FIG. 4. Other methods of intertwining the loops also are possible, and more or less than three loops can be intertwined to form a suitable braid or other intertwined arrangement.

Figure 5:
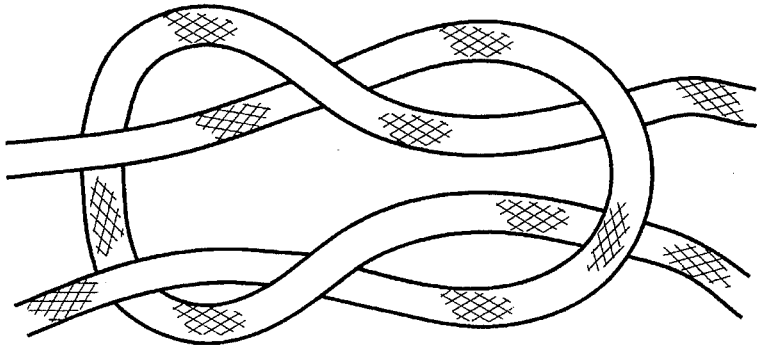
FIG. 5 is a perspective view of a square knot which may be used to add additional loops to lengthen to the "braid" of the scrubber.
Figure 4:
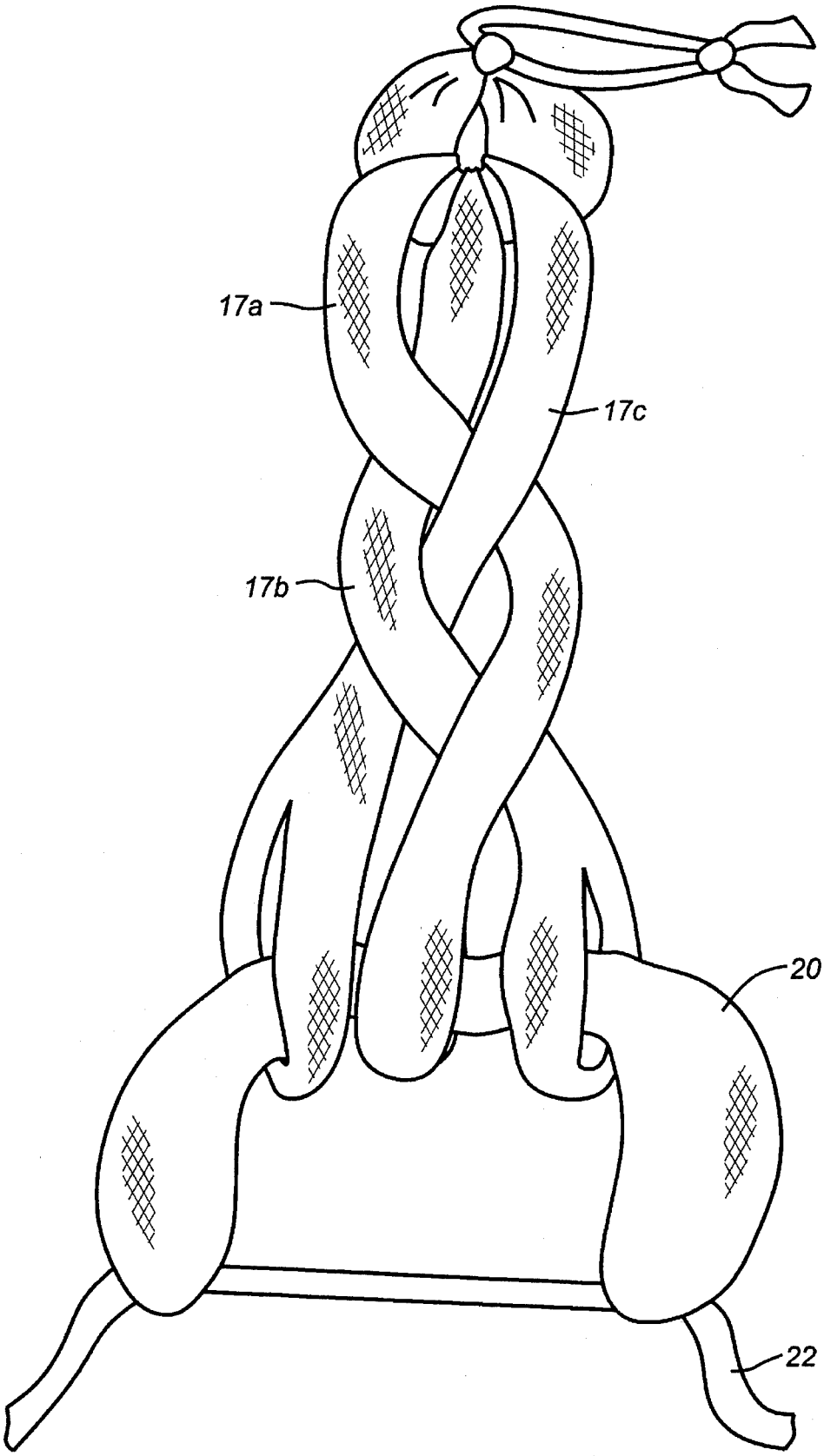
FIG. 4 is a perspective view of a later stage in the assembly of a scrubber according to the present invention.

The length of the intertwined loops 17 may be increased either by using tubes of netting which have a larger diameter to form loops 17*a*–17*c*, or by attaching a second set of loops to extend loops 17*a*–17*c*, for example, using a square knot, as shown in FIG. 5. Alternative means of attaching additional loops will be evident to a person of skill in the art. Once the loops 17*a*–17*c* have been intertwined or braided, a second end loop 20 should be run through the free ends of loops 17*a*–17*c*, as shown in FIG. 4, and secured in a manner similar to end loop 16. The resulting scrubber is shown in FIG. 1.

A person of skill in the art will recognize that many modifications may be made to the present invention without departing from the spirit and scope of the invention. The embodiments described herein are meant to be illustrative only and should not be taken as limiting the invention, which is defined in the following claims.

We claim:

1. A washing device comprising:

a plurality of elongated loops of netting having an open-celled structure and comprised of non-porous material, each of said loops having first and second ends and having given length between said first and second ends, said loops being intertwined along said lengths, each of said first ends being aligned adjacent to one another, and each of said second ends being aligned adjacent to one another;

an end grip extending through each of said adjacent first ends of said loops; and an end grip extending through each of said adjacent second ends of said loops, said end grips maintaining said loops intertwined to form an elongated washing member;

wherein said end grips comprise end loops of said netting having first and second ends, said end loops extending through each of said first adjacent ends and said second adjacent ends of said intertwined loops, folding back on themselves, and being secured together at said first and second ends.

2. The washing device of claim 1 wherein said netting is diamond mesh polyethylene netting.

3. The washing device of claim 2 comprising at least three loops of intertwined netting.

4. The washing device of claim 3 wherein said loops of netting are intertwined to form a braid.

5. The washing device of claim 1 comprising at least three loops of intertwined netting.

6. The washing device of claim 1 wherein said loops of netting are intertwined to form a braid.

7. A washing device comprising:

at least three elongated loops of netting having an open-celled structure and comprised of non-porous material, each of said loops having first and second ends and having a given intermediate length between said first and second ends, each of said first ends being aligned adjacent to one another, and each of said second ends being aligned adjacent to one another;

an end grip extending through and joining each of said adjacent first ends of said loops; and an end grip extending through and joining each of said adjacent second ends of said loops;

wherein said loops are braided together at least once along said intermediate length, forming an elongated washing member.

8. The washing device of claim 7 wherein said washing member has a substantially continuous diameter.

9. The washing device of claim 8 wherein said netting is diamond mesh polyethylene netting.

10. A process for producing a washing device comprising the steps of:

providing at least three elongated loops of netting having an open-celled structure and comprised of non-porous material, each of said loops having first and second ends and having a given intermediate length between said first and second ends;

positioning each of said first ends of said loops adjacent to one another and securing each of said first ends of said loops together with an end grip;

intertwining said loops along said intermediate length to form at least one intermediate braid between said first and second ends;

aligning each of said second ends adjacent to one another; securing each of said second ends of said loops together with an end grip, forming an elongated washing member.

11. The process of claim 10 wherein said loops are prestretched.

12. The process of claim 11 wherein said loops are intertwined to form a braid.

13. The process of claim 12 wherein said first and second ends of said loops are secured by extending end loops of said netting having first and second ends through each of said first adjacent ends and said second adjacent ends of said loops;

folding said end loops back on themselves; and securing said first and second ends of said end loops together.

14. The process of claim 10 wherein said first and second ends of said loops are secured by extending end loops of said netting having first and second ends through adjacent ends of said intertwined loops;

folding said end loops back on themselves; and securing said first and second ends of said end loops together.

15. A washing device produced by a process comprising the steps of:

providing at least three elongated loops of netting having an open-celled structure and comprised of non-porous material, each of said loops having first and second ends and having a given intermediate length between said first and second ends;

positioning each of said first ends of said loops adjacent to one another and securing each of said first ends of said loops together with an end grip;

intertwining said loops along said intermediate length to form at least one intermediate braid between said first and second ends;

aligning each of said second ends adjacent to one another;

securing each of said second ends of said loops together with an end grip, forming an elongated washing member.

* * * * *